US010738386B2

(12) United States Patent
Shannon et al.

(10) Patent No.: US 10,738,386 B2
(45) **Date of Patent: *Aug. 11, 2020**

(54) ELECTRODE ASSEMBLY, ELECTROLYSERS AND PROCESSES FOR ELECTROLYSIS

(71) Applicant: INEOS TECHNOLOGIES SA, Vaud (CH)

(72) Inventors: Gary Martin Shannon, Macclesfield (GB); Brian Kenneth Revill, Sarzeau (FR)

(73) Assignee: INEOS TECHNOLOGIES SA, Vaud (CH)

( * ) Notice: Subject to any disclaimer, the term of this patent is extended or adjusted under 35 U.S.C. 154(b) by 176 days.

This patent is subject to a terminal disclaimer.

(21) Appl. No.: 15/567,694

(22) PCT Filed: Apr. 12, 2016

(86) PCT No.: PCT/EP2016/058016

§ 371 (c)(1),
(2) Date: Oct. 19, 2017

(87) PCT Pub. No.: WO2016/169812

PCT Pub. Date: Oct. 27, 2016

(65) Prior Publication Data

US 2018/0105942 A1 Apr. 19, 2018

(30) Foreign Application Priority Data

Apr. 20, 2015 (EP) ..... 15164303
Apr. 20, 2015 (EP) ..... 15164309

(51) Int. Cl.
*C25D 17/10* (2006.01)
*C25D 17/12* (2006.01)
(Continued)

(52) U.S. Cl.
CPC ..... *C25B 1/24* (2013.01); *C25B 9/066* (2013.01); *C25B 9/206* (2013.01); *C25B 15/08* (2013.01)

(58) Field of Classification Search
CPC ..... C25D 17/10; C25D 17/12; C25D 17/004; C25D 21/12; C25D 17/02; C25B 9/18; C25B 9/00; C25B 9/12
(Continued)

(56) References Cited

U.S. PATENT DOCUMENTS 3,463,722 A 8/1969 Westerlund
3,732,153 A 5/1973 Harke et al.
(Continued)

FOREIGN PATENT DOCUMENTS

CA 892 733 A 2/1972
CN 101550552 10/2009
(Continued)

OTHER PUBLICATIONS

Presentation by UhdeNora; "Development update of UHDENORA technologies", CloroSur—2012 (31 pgs.).
(Continued)

*Primary Examiner* — Zulmariam Mendez
(74) *Attorney, Agent, or Firm* — Nixon & Vanderhye P.C.

(57) ABSTRACT

The present invention relates to an electrode assembly and an electrolyser using said assemblies/structures, wherein the electrode assembly comprises an anode structure and a cathode structure, each of said anode structure and cathode structure comprising an outlet header for evolved gas and spent liquid, wherein each of said anode structure and cathode structure comprising an outlet header for evolved gas and spent liquid, wherein the outlet header on the anode structure has a total internal volume of $V_A$ cm$^3$ and the outlet header on the cathode structure has a total volume of $V_C$ cm$^3$
(Continued)

wherein $V_A$ is less than $V_C$, and/or i) the outlet header on the anode structure has an internal volume, $V_A$ $cm^3$, an internal cross sectional area at the exit end of the header of $A_A$ $cm^2$ and an internal length $L_A$ cm, and ii) the outlet header on the cathode structure has an internal volume, $V_C$ $cm^3$, an internal cross sectional area at the exit end of the header of $A_C$ $cm^2$ and an internal length $L_C$ cm, and one or both of the ratios $V_A/(A_A \times L_A)$ and $V_C/(A_C \times L_C)$ are less than 1.

17 Claims, 6 Drawing Sheets

(51) Int. Cl.

| | |
|---|---|
| ***C25D 21/12*** | (2006.01) |
| ***C25B 1/24*** | (2006.01) |
| ***C25B 9/20*** | (2006.01) |
| ***C25B 15/08*** | (2006.01) |
| ***C25B 9/06*** | (2006.01) |

(58) Field of Classification Search
USPC ..... 204/280
See application file for complete search history.

(56) References Cited

U.S. PATENT DOCUMENTS

| | | | | |
|---|---|---|---|---|
| 4,505,789 | A | 3/1985 | Ford | |
| 5,314,591 | A | 5/1994 | Katayama et al. | |
| 6,761,808 | B1 * | 7/2004 | Revill ..... | C25B 9/08 204/257 |
| 2004/0118677 | A1 | 6/2004 | Streckert et al. | |
| 2006/0108215 | A1 | 5/2006 | Tzedakis et al. | |

FOREIGN PATENT DOCUMENTS

| | | |
|---|---|---|
| EP | 0 521 386 A2 | 1/1993 |
| EP | 0 521 386 A3 | 1/1993 |
| EP | 0 704 556 A1 | 4/1996 |
| GB | 1 581 348 | 12/1980 |
| GB | 1 595 183 | 8/1981 |

OTHER PUBLICATIONS

Presentation by"INEOS Technologies Integrated Service", CLORO SUR—2012 (36 pgs.).

* cited by examiner

ELECTRODE ASSEMBLY, ELECTROLYSERS AND PROCESSES FOR ELECTROLYSIS

This application is the U.S. national phase of International Application No. PCT/EP2016/058016 filed Apr. 12, 2016 which designated the U.S. and claims priority to European Patent Application Nos. 15164303.8 filed Apr. 20, 2015, and 15164309.5 filed Apr. 20, 2015, the entire contents of each of which are hereby incorporated by reference.

The present invention relates to an electrode assembly, an electrolyser using said assemblies and a process operating in an electrolyser, in particular but not exclusively for use in the electrolysis of alkali metal chlorides.

Bipolar electrolysers are known in the art, for example as described in GB 1581348 or U.S. Pat. No. 6,761,808.

Bipolar electrolysers for use in the electrolysis of aqueous solutions of alkali metal chloride may comprise an electrode module comprising an anode which is suitably in the form of a plate or mesh of a film-forming metal, usually titanium carrying an electrocatalytically active coating, for example a platinum group metal oxide, and a cathode which is suitably in the form of a perforated plate of metal or mesh, usually nickel or mild steel. The anode and cathode are separated by a separator, typically a membrane, to form a module.

In a commercial modular electrolyser a multiplicity of such modules are placed in sequence with the anode of one bipolar module next to and electrically connected to the cathode of an adjacent bipolar module.

In operating an electrolyser of the bipolar type it is advantageous to operate with as small a distance as possible between the anode and cathode (the anode/cathode gap) in order to keep ohmic losses, and hence the cell voltage to a minimum.

Another type of bipolar electrolyser is a so-called "filter press electrolyser", for example as described in GB 1595183. In these electrolysers bipolar electrode units are formed comprising an anode structure and a cathode structure which are electrically connected to each other. The bipolar electrode units are then connected to adjacent bipolar electrode units via a separator and sealing means between flanges on the adjacent units, and the units compressed together to form a filter press electrolyser.

U.S. Pat. No. 6,761,808 describes an electrode structure comprising a pan with a dished recess and a flange for supporting a gasket capable of sealing a separator between the surface of an anode and a cathode. The dished recess has projections which mate with projections on an adjacent electrode structure. These electrode structures may be assembled into electrolyser modules or bipolar electrode units, and then further combined to form modular electrolysers or filter press electrolysers.

The anode and cathode structures in a bipolar electrolyser comprise independent inlets for liquid to be electrolysed and outlet headers for evolved gases.

CA892733 relates to an electrolysis apparatus. In this document there is described the presence of internal headers for both the anolyte and catholyte zones which respectively communicate with external headers for each of set of zones. The outlet headers in this document are therefore internal headers, whilst the external headers as described are collection headers which collect the products from multiple outlet headers.

U.S. Pat. No. 3,463,722 discloses a tapered external header which runs perpendicular to the different electrolysis chambers and collects product from each. As shown in FIG. 4 or 12-16 each cell has a separate internal outlet header which communicates with the common external collection header.

US 2006/108215 describes a microchannel electrochemical reactor in which the internal headers are tapered.

We have now found an improved electrolyser by adapting the size and/or shape of the outlet header(s).

Thus, in a first aspect, the present invention provides an electrode assembly comprising an anode structure and a cathode structure, each of said anode structure and cathode structure comprising an outlet header for evolved gas and spent liquid, wherein i) the outlet header on the anode structure has an internal volume, $V_A$ cm$^3$, an internal cross sectional area at the exit end of the header of $A_A$ cm$^2$ and an internal length $L_A$ cm, and ii) the outlet header on the cathode structure has an internal volume, $V_C$ cm$^3$, an internal cross sectional area at the exit end of the header of $A_C$ cm$^2$ and an internal length $L_C$ cm.

and wherein one or both of the ratios $V_A/(A_A \times L_A)$ and $V_C/(A_C \times L_C)$ are less than 1.

The first aspect of the present invention relates to an electrode assembly comprising an anode structure and a cathode structure. As used herein the term "electrode assembly" means an assembly of a single anode structure and a single cathode structure. The term "electrode assembly" encompasses both bipolar electrode units and electrode modules depending on how the anode and cathode are connected.

Typically, each electrode structure comprises i) a flange which can interact with a flange on an another electrode structure to hold a separator in between the two, ii) an electrolysis compartment which contains an electrode, and which in use contains a liquid to be electrolysed, iii) an inlet for the liquid to be electrolysed and iv) an outlet header for evolved gas and spent liquid.

To aid in understanding of such structures and of the present invention generally the following further definitions apply herein:

"bipolar electrode unit" is an electrode assembly comprising an anode structure and a cathode structure which are electrically connected to each other. In general, bipolar electrode units may be connected to adjacent bipolar electrode units via a separator and sealing means between flanges on the adjacent units to form a filter press electrolyser.

"electrode module" is an electrode assembly comprising an anode structure and a cathode structure which are separated by a separator between the respective flanges. The electrode module is provided with a sealing means to achieve a liquid and gas tight seal between the separator and the respective flanges. Electrode modules may be electrically connected to adjacent electrode modules to form a modular electrolyser.

"electrode structure" means a single cathode structure or a single anode structure. Typically each electrode structure comprises a flange, an electrolysis compartment, an inlet and an outlet header as described above.

"electrolyser", when used by itself means a filter press electrolyser or a modular electrolyser.

"electrolyser collection header" is a volume which collects the gases evolved during electrolysis from the exits of multiple outlet headers, and passes them to further processing. An electrolyser may have a single electrolyser collection header or multiple electrolyser collection headers, but there are always significantly less electrolyser collection headers than electrode structures.

"electrolyser feed header" is a volume which feeds liquid to be electrolysed to the inlets of multiple electrode structures, such as to the inlets of multiple inlet headers when present. An electrolyser may have a single electrolyser feed header or multiple electrolyser feed headers, but there are always significantly less electrolyser feed headers than electrode structures.

"electrolysis compartment" is a volume within the electrode structure which contains an electrode and which in use contains a liquid to be electrolysed.

"electrode", when used by itself, refers to the electroconductive plate or mesh found in the electrolysis compartment of an electrode structure. The same applies to the terms "anode" and "cathode" when used by themselves.

"external outlet header" means an outlet volume by which gases evolved during electrolysis the electrode structure and which is provided on the electrode structure outside of the electrolysis compartment.

"filter press electrolyser" means a plurality of connected bipolar electrode units, adjacent bipolar electrode units being connected via a separator and sealing means between flanges on the adjacent units.

"inlet" as used herein refers to the inlet by which liquid to be electrolysed enters an electrode structure. Each electrode structure will have at least one inlet. Preferred inlets are in the form of "inlet headers". The inlets of multiple electrode structures of the same type (anode or cathode) may be fed in use from a common electrolyser feed header.

"inlet header" as used herein means an inlet volume which is part of an individual electrode structure by which liquid to be electrolysed enters the electrolysis compartment of the electrode structure. The inlet header is generally an extended volume which is aligned parallel with the long horizontal axis of the electrode structure. The inlets of the inlet headers of multiple electrode structures of the same type (anode or cathode) may be fed in use from a common electrolyser feed header.

"internal outlet header" means an outlet volume by which gases evolved during electrolysis exit the electrode structure and which is provided on the electrode structure inside of the electrolysis compartment.

"modular electrolyser" means a plurality of connected electrode modules.

"outlet header" as used herein means an outlet volume which is provided on an individual electrode structure and by which gases evolved during electrolysis exit the electrode structure. Each electrode structure in an electrolyser will have an outlet header. The outlet header of a particular electrode structure may be internal or external.

"sealing means" are structures made from chemically resistant, insulating, compressible substances, such as gaskets, designed to be compressed between a flange and a separator to achieve a liquid and gas tight seal.

"separator" is used to refer to the means which sits between the anode in an anode structure and the cathode in an adjacent cathode structure whilst providing fluid separation between the respective electrolysis compartments of said anode and cathode structures. The separator is preferably an electroconductive membrane, such as an ion-exchange membrane.

In the present invention one or both of the ratios $V_A/(A_A \times L_A)$ and $V_C/(A_C \times L_C)$ are less than 1.

As used herein, the various lengths, volumes and areas are determined internally on each header. The internal length is the minimum internal straight-line distance from the exit end to the opposite end of the header.

In the present invention the length, cross-sectional area and the volume should be determined ignoring the presence of any internals in the header.

In terms of the volume, $V_A$ and $V_C$ are defined respectively as the total volumes contained within the anode or cathode electrode structure above a plane running horizontally along the axis in the same direction as the length of the header and located at the bottom of the trough which channels gasses and liquors produced by the electrode to the exit end.

In conventional headers with constant cross-section along their length e.g. rectangular, then $V_A/(A_A \times L_A)$ and $V_C/(A_C \times L_C)$ are both equal to 1.

In the present invention, at least one of these is less than 1. This can be achieved by having a header which has a non-constant cross-section along its length.

In a preferred embodiment this is achieved by making the outlet header tapered such that its cross-sectional area increases along its length towards the exit end. It will however be apparent that other options, such as header with step reductions in cross-section can also obtain the required relationship.

Where this invention is applied to the cathode, preferably, $V_C/(A_C \times L_C)$ is less than 0.75. There is no specific lower limit but $V_C/(A_C \times L_C)$ may be generally less than 0.55, such as low as 0.35.

It is particularly preferred however that at east the outlet header on the anode structure has $V_A/(A_A \times L_A)$ of less than 1.

More preferably $V_A/(A_A \times L_A)$ has less than 0.95. There is no specific lower limit but $V_A/(A_A \times L_A)$ may be generally less than 0.7, such as low as 0.4.

$V_A$ in the first aspect of the present invention is typically less than 3100 $cm^3$, such as less than 2800 $cm^3$, for example 2300 $cm^3$.

$V_C$ may be the same as $V_A$, but need not be. In one embodiment $V_A$ may be less than $V_C$, such as 100 $cm^3$, more preferably 250 $cm^3$ less than $V_C$.

$A_A$ is preferably at least 7 $cm^2$ and preferably at least 15 $cm^2$.

$A_C$ may be the same as $A_A$, but need not be. In a preferred embodiment $A_C$ is less than $A_A$, and preferably at least 5 $cm^2$ less than $A_A$.

The length of the anode $L_A$ in this first aspect is typically greater than 50 cm and preferably greater than 150 cm such as 230 cm.

$L_C$ may not be, but preferably is the same as $L_A$.

As noted, it is preferred that $V_A$ is less than $V_C$.

Thus, in a second aspect, the present invention provides an electrode assembly comprising an anode structure and a cathode structure, each of said anode structure and cathode structure comprising an outlet header for evolved gas and spent liquid, wherein the outlet header on the anode structure has a total internal volume of $V_A$ $cm^3$ and the outlet header on the cathode structure has a total volume of $V_C$ $cm^3$ wherein $V_A$ is less than $V_C$.

Preferably this is achieved by reducing the volume of the outlet header on the anode structure such that at least this header has $V_A/(A_A \times L_A)$ of than 1. More preferably $V_A/(A_A \times L_A)$ in this aspect is less than 0.95. for example less than 0.7, such as as low as 0.4. Especially preferred is that the anode outlet header is tapered such that its cross-sectional area increases along its length.

The anode structure and cathode structure may generally be as described for the first aspect.

In particular in terms of dimensions, $V_A$ is typically less than 3100 $cm^3$, such as less than 2800 $cm^3$. $V_A$ is less than $V_C$ and may in particular be 100 $cm^3$ less, preferably 250 $cm^3$ less, than $V_C$.

$A_A$ in this second aspect is preferably at least 7 $cm^2$ and preferably at least 15 $cm^2$. $A_C$ in this second aspect may be the same as $A_A$, but need not be. In a preferred embodiment $A_C$ is less than $A_A$, and preferably at least 5 $cm^2$ less than $A_A$.

The length of the anode $L_A$ in this second aspect is typically greater than 50 cm and preferably greater than 150 cm such as 230 cm. $L_C$ may not be, but preferably is the same as $L_A$.

Although preferred and advantageous more specific features of the present invention are described further herein, other than the requirements on the outlet headers in the present invention, the electrode structures are preferably broadly as defined in U.S. Pat. No. 6,761,808.

As described in U.S. Pat. No. 6,761,808 such a structure allows very small or even zero anode/cathode gaps to be used without damage to the separator, and minimises electrical resistance by using a short perpendicular current-carrying path length between electrodes and low resistance materials for almost the entire perpendicular current-carrying path length and which affords excellent current distribution throughout the electrode area. The electrode structure permits both horizontal and vertical flow of liquors therein aiding circulation and mixing thereof and has improved rigidity and strength which allows closer tolerance to be achieved in cell construction, and also is of simple construction and easy to fabricate.

For example, each electrode structure preferably comprises a pan with a dished recess, wherein the flange is around the periphery of the pan, and an electrode spaced apart from the pan.

Each electrode structure comprises an electrolysis compartment, which is a volume within the electrode structure which contains an electrode and which in use contains a liquid to be electrolysed. In use of an electrode structure comprising a pan with a dished recess wherein the flange is around the periphery of the pan, the electrolysis compartment is the volume formed by a pan on one side, and by a separator held between the electrode and an adjacent electrode on the other side. In particular the flange can support a gasket capable of sealing the separator between the anode of an anode structure and the cathode of a cathode structure such that the anode is substantially parallel to and faces but is spaced apart from the cathode by the separator and the electrode structures are hermetically sealed to the separator at the flange.

The gaskets for sealing the separator between the flanges are generally as known in the art. They may be different in the anode and cathode structures, but are typically made from a suitable material with appropriate chemical resistance and physical properties, such as a plasticised EPDM resin. Where a material does not have a suitable combination of chemical resistance and physical properties a gasket made from a material having suitable physical properties may be provided with a chemically resistant liner, for example made of PTFE, on its inner edge.

The gasket may be in the form of a frame, preferably continuous, such that when two gaskets are disposed either side of a separator and a load applied thereto via the pans hermetic sealing of the module is effected.

The gasket may contain holes to accommodate sealing bolts.

The separator is preferably a substantially electrolyte-impermeable ion-exchange membrane. However, we do not exclude the possibility that it may be a porous electrolyte-permeable diaphragm. Ion permselective membranes for chlor/alkali production are well known in the art. The membrane preferably a fluorine-containing polymeric material containing anionic groups. Preferably it is an anion group-containing polymer containing all C—F and no C—H bonds. As examples of suitable anion groups may be mentioned $—PO_3^{2-}$, $—PO_2^{2-}$, or preferably $—SO_3^-$ or $—COO^-$.

The membrane may be present as a mono- or multi-layer film. It may be reinforced by being laminated with or coated onto a woven cloth or microporous sheet. Furthermore, it may be coated on one or both sides with a chemically resistant particulate coating to improve wetting and gas release.

Where a membrane bearing a surface coating is employed in chloralkali applications the surface coating is typically formed from a metal oxide inert to the chemical environment, e.g. zirconia Suitable membranes for chloralkali applications are sold, for example, under the tradenames "Nafion" by The Chemours Company LLC (a subsidiary of E I Du Pont de Nemours and Company), "Flemion" by the Asahi Glass Co. Ltd. and "Aciplex" by the Asahi Kasei Co. Ltd.

The electrode is a formed or perforated electroconductive plate or mesh. In operation electrolysis is carried out on the electrode. Preferably the electrode is coated with an electrocatalytic coating to facilitate electrolysis at lower voltages. Electrodes may be anodes or cathodes depending on whether the electrochemical reaction they are promoting is oxidative or reductive.

The dished recess may have projections which allow one electrode structure to mate with an adjacent electrode structure. The projections in the dished recess are preferably spaced apart from each other in a first direction and in a direction transverse to the first direction.

Preferred recess and projections are broadly as defined in U.S. Pat. No. 6,761,808. For example, preferably the dished recess of one of the anode structure and cathode structure is provided with a plurality of outwardly projecting projections and the other of the anode structure and cathode structure is provided with a plurality of inwardly projecting projections the projections being such that the outwardly projecting projections can mate with the inwardly projecting projections in an adjacent electrode structure or electrode module in a modular electrolyser. ("Inward" as used in this context refers to projections which project from the recess in to the electrolysis compartment, whereas "outward" refers to projections which project from the recess out from the electrolysis compartment.)

Preferably the cathode structure comprises a dished recess provided with a plurality of outwardly projecting projections and the anode structure comprises a dished recess provided with a plurality of inwardly projecting projections.

The projections in the dished recess are preferably spaced apart from each other in a first direction and in a direction transverse to the first direction. More preferably the projections are symmetrically spaced apart. For example, they may be spaced apart by an equal distance in a first direction, and spaced apart by an equal distance, which may be the same, in a direction transverse, for example substantially at right angles, to the first direction. Preferably the spacing apart of the projections is the same in both directions.

Preferably each projection in a dished recess is electroconductively connected to an electrically conductive member such that the projections provide many current feed-points hence improving current distribution across the pan leading to lower voltage, lower power consumption and longer separator and electrode coating lives.

The projections in the dished recess may have a variety of shapes, for example dome, bowl, conical or frusto-conical. The preferred shape in the present invention is frusto-spherical. Such projections are simple to manufacture whilst providing improved resistance to pressure.

In the present invention there are typically about 20-200, preferably 60-120, projections/metre squared on the dished recess of the pan of the electrode structure.

The height of the projections from the plane at the base of the dished recess may for example be in the range 0.5-8 cm, preferably 1-4 cm, depending on the depth of the pan. The distance between adjacent projections on the recessed dish may for example be 1-30 cm centre to centre, preferably 5-20 cm. The dimensions of the electrode structure in the direction of current flow are preferably in the range 1-6 cm, as measured from the electrode to the plane at the base of the dished recess, in order to provide short current paths which ensure low voltage drops in the electrode structure without the use of elaborate current carrying devices.

The inlet for liquid may be any suitable inlet, for example one or more tubes. It generally resides at the lower part of the electrode structure. For example, it may be provided at the bottom of the electrode structure extending lengthwise along the width of the structure from one side thereof to the other, to allow liquid to be charged thereto. Where the modular bipolar electrolyser is to be used for brine electrolysis the inlet allows caustic to be charged to the cathode structure and brine to be charged to the anode structure. Ports may be spaced along the length of an inlet to improve liquid feed distribution across the width of the electrode structure. The number of ports for any particular application may be readily calculated by the skilled man.

Evolved gases are discharged from the electrode structures through an outlet header. Although the outlet headers are defined herein in relation to gases evolved during electrolysis spent liquid/liquor is generally also discharged through the outlet header with the evolved gases. In the outlet header gas/liquid separation occurs such that the gas and liquid can be separately recovered. The gas and liquid streams leave the outlet headers through one or more exit ports, preferably one exit port, more preferably disposed at one end thereof.

The gas and liquid streams generally exit the outlet header into an electrolyser collection header, which passes them to further processing. The exits of the outlet headers of multiple electrode structures of the same type (anode or cathode) are generally joined in use to a common electrolyser collection header. An electrolyser may have a single electrolyser collection header or multiple electrolyser collection headers, but there are always significantly less electrolyser collection headers than electrode structures. For avoidance of doubt, as defined herein an outlet header is a separate and distinct feature from an electrolyser collection header, not least because each electrode structure comprises an individual outlet header, whereas a single electrolyser collection header collects gas from multiple electrode structures.

A further point of distinction which arises is in the orientation of outlet headers and collection headers.

In particular, each outlet header according to the present invention is generally an extended volume which is aligned parallel with the long horizontal axis of the electrode structure. This enables the outlet header to communicate with (and thereby remove evolved gas and spent liquid) at multiple points along the length of the electrode structure, which provides more efficient removal.

In contrast, an electrolyser collection header is generally aligned in a direction perpendicular to the long horizontal axes of individual electrode structures because its objective is to collect evolved gas (and liquid) from multiple outlet headers from multiple electrode structures.

In the present invention "internal outlet header" refers to an outlet volume provided on the electrode structure inside of the electrolysis compartment. Internal outlet headers are generally less costly to manufacture because they need less metal. Further, electrode structures with internal outlet headers have the advantage of a higher pressure rating, and operating at higher pressure allows a lower voltage. An internal outlet header is preferably located at or close to the top of the electrolysis compartment. Preferably the top of an internal outlet header resides below the upper level of the flange on the electrode structure.

An internal outlet header generally communicates with the electrolysis area via one or more apertures or slots. Preferably, during electrolysis the gas/liquid mixture obtained by the electrolysis flows upwardly through the electrolysis compartment and then spills horizontally from the top of the electrolysis area into the internal outlet header through one or more apertures or slots formed between the top of the outlet header wall and the top of the electrolysis compartment.

The gas/liquid mixture separates out rapidly in the internal outlet header, which preferably runs along substantially the entire width of the electrode structure.

An internal outlet header preferably has a generally rectangular cross-section although in the present invention the cross-sectional area can vary along its length. The height and width of the apertures or slots and the cross-sectional area of the outlet header can be chosen in the light of inter alia the current density, electrode area and temperature such that it fits within the depth of the electrolysis compartment, providing sufficient space for liquors and gasses to circulate freely therein, whilst allowing sufficient space in the header itself to ensure that stratified horizontal gas/liquid flow along the header, preferably with a smooth interface, is maintained.

Typically the maximum depth of the internal outlet header is between 30%-85% of the depth of the electrolysis compartment, more preferably between 50%-70% of the depth of the electrolysis compartment. The height of the internal outlet header is specified so as to achieve the required cross sectional area subject to the shape and depth of the outlet header. ("Depth" as used in this context is measured along an axis which is perpendicular to the plane of the back wall of the electrode pan, whilst "height" is measured along an axis in the plane of the back wall of the electrode pan which is vertical when the pan is in operation. (The third dimension is "width" and is measured along an axis in the plane of the back wall of the electrode pan which is horizontal when the pan is measured in operation and in the present invention correlates with the length dimension of the header.))

The apertures or slots are designed to ensure that the gas phase is dispersed as bubbles in a continuous liquid phase in the electrolysis compartment and through the slots without premature gas disengagement or slugging. The height of the slot is typically from 2-20 mm, preferably 5-10 mm. Where more than one slot is provided they are preferably dispersed evenly across the width of the electrolysis compartment. Preferably the total length of the slot or slots is greater than 70% of the width of the electrolysis compartment, more preferably greater than 90%. Most preferably a single slot is provided extending the entire width (100%) of the electrolysis compartment.

An internal outlet header preferably communicates with the external pipework via a single orifice.

The use of an external outlet header on at least one of the electrodes has the advantage that the upper region of the electrolysis compartment can be kept "liquid full" and hence damage to the separator caused by formation of a gas space adjacent the separator in the upper region of the electrolysis compartment is reduced, and often eliminated.

Further, because the respective gases do not collect in the top of the electrolysis compartment on both sides of the separator the invention eliminates any risk of gas from one side seeping through to the other. For example, with hydrogen and chlorine this could lead to the risk of forming an explosive mixture of the two. (Typically as a result of hydrogen migration because the hydrogen side of the separator is usually run at a slightly higher pressure than the chlorine side.)

In the present invention "external outlet header" refers to an outlet volume which is provided on the electrode structure outside of the electrolysis compartment. Preferably the bottom of the external outlet header resides above the upper level of the electrolysis compartment.

Generally, in an external outlet header the gas/liquid mixture flows upwardly from the electrolysis area through one or more apertures or slots at the top of the electrolysis compartment and into the external outlet header. A surface level of fluid may be maintained in the external outlet header. In a preferred embodiment of the present invention, an external outlet header is provided along substantially the entire width of the electrode structure. The one or more slots preferably run along essentially the same width as the external outlet header.

The depth of the slots will be chosen in the light of inter alia the current density electrode area and temperature such that the gas phase is dispersed as bubbles in a continuous liquid phase. The depth of the slot is typically about 5-70%, preferably about 10-50%, of the depth of the electrolysis compartment structure i.e. the distance between the plane through the bottom of the dished recess and the separator where present.

The gas/liquid mixture separates out rapidly in the external outlet header, which runs along substantially the entire width of the electrode structure.

The outlet header may have a generally rectangular cross-section although in the present invention the cross-sectional area can vary along its length. The cross-sectional area of the outlet header can be chosen in the light of inter alia the current density, electrode area and temperature such that stratified horizontal gas/liquid flow along the header, preferably with a smooth interface is maintained.

It has been found that an improved electrode structure with an external outlet header can be obtained if the outlet header is tapered, and in particular increases in cross-section area in the direction of gas/liquid flow towards the exit end (port(s)). A tapered header can use less metal compared to a non-tapered outlet header. A further advantage of the tapered external outlet header is that less reinforcement is required by way of increased metal thickness or by the addition of internal supports to make it capable of operating at higher pressures, hence reducing cost of manufacture.

In one embodiment of the present invention, one of the anode outlet header and cathode outlet header is an external outlet header and the other is an internal outlet header. For avoidance of doubt, where an electrode assembly comprises both an electrode structure with an external outlet header and an electrode structure with an internal outlet header, the individual electrode structures preferably comprise only an internal outlet header as defined herein or only an external outlet header as defined, but not both internal and external outlet headers on the same electrode.

A particular advantage where one of the anode outlet header and cathode outlet header is an external outlet header and the other is an internal outlet header is that there is more space above an electrode module or a bipolar electrode unit for the single external outlet header which is present, which enables more flexibility in the design thereof, and in particular in the horizontal depth thereof. (For avoidance of doubt, "depth" as used in the context of the header, for consistency with the use of the term for the electrode structure generally, is measured along an axis which is perpendicular to the plane of the back wall of the electrode pan,) This enables further improvements in separation to be obtained in the header.

For example, the depth of the external outlet header can exceed the depth of the electrolysis compartment of the electrode structure to which it is attached. As a particular example, the external outlet header of the electrode structure which has said external outlet header can occupy space which is vertically above the adjacent electrode structure in an electrode module, bipolar electrode unit, modular electrolyser or filter press electrolyser.

Furthermore the use of an internal outlet header reduces the thickness of metal needed to make the electrolyser capable of running at elevated pressure compared to the alternative of two external headers because the internal header does not have to be pressure resistant. Therefore less metal and thinner metal can be used for the internal outlet header.

In a particular preferred embodiment of the present invention, the outlet header on the anode structure is an external outlet header and the outlet header on the cathode structure is an internal outlet header. This is preferred because it has been found that the separator is most prone to damage caused by the formation of a gas space adjacent the separator on the anode side in the upper region of the electrolysis compartment, and also because the separation of formed chlorine from spent brine is the most problematic. This is due to, for example, the density, viscosity and surface tension of the chlorine gas/liquid brine mixture, and in particular the mixture of chlorine and brine is most prone to foaming. The external outlet header located above the electrolysis compartment allows to minimise these problems because its location moves the gas disengagement area away from the separator and also provides increased flexibility to design its shape and size to improve the separation.

One or both outlet headers may comprise one or more internal cross members, and in particular cross-members may be located along part of or all of the length of and attached internally to the sides of the header. Preferably the cross members are strips running internally, for example horizontally, along the length of the outlet header(s), attached to the sides of the header(s). The cross members may be provided with holes through the strips communicating from top to bottom.

Such cross members may be provided, for example, to increase the pressure rating of the headers. It is preferred that at least the external outlet header comprises one or more such internal cross members.

It has been found however that the cross-members can also help to improve the separation in the header. Thus, even where improved pressure rating is not required, such as in the internal header, the use of cross-members is advantageous and is preferred. In the preferred electrode structure comprising a pan with a dished recess (wherein the flange is around the periphery of the pan, and with an electrode spaced apart from the pan) electrically conducting pathways are formed between the dished recess and the electrode.

In one embodiment electrically conductive posts (hereinafter simply "posts") may connect the dished recess directly to the electrode.

The electrically conducting pathways are preferably formed via current carriers comprising a central portion from which one or more legs radiate, and where the ends of the legs (feet) of the current carriers are electrically connected to the electrode.

In most preferred embodiments the electrically conducting pathways comprise one or more current carriers each comprising a central portion from which one or more legs radiate and where the ends of the legs (feet) of the current carriers are electrically connected to the electrode and the central portions are electrically connected to the dished recess of the pan. The central portions are preferably electrically connected to the dished recess of the pan via posts i.e. the electrically conducting pathways are formed via posts from the projections of the dished recess to current carriers each comprising a central portion from which one or more legs radiate and where the ends of the legs (feet) of the current carriers are electrically connected to the electrode.

Again such a configuration is as generally described in U.S. Pat. No. 6,761,808.

For example, the current-carrier is preferably a multi-legged current-carrier comprising a central portion from which multiple legs radiate, and where the ends of the legs (feet) of the current carriers are electrically connected to the electrode, hereinafter referred to for convenience as a "spider". The electrical connections may be made without using a post: for instance, in the case of an anode structure, the apex of each inwardly directed projection may be electrically connected to the anode plate by means of a current carrier. The use of posts and current carriers is preferred.

The provision of spiders increases the number and distribution of current feed points to the electrically conductive plate, hence improving current distribution leading to lower voltage and power consumption and longer life of separators and electrode coatings.

The length of the legs and the number thereof on the spiders, where a spider is present, may vary within wide limits. Typically each spider contains between 2 and 100 legs, preferably between 2 and 8 legs. Typically each leg is between 1 mm and 200 mm long, preferably between 5 mm and 100 mm long. The skilled man by simple experiment will be able to determine suitable lengths and numbers of spider legs for any particular application.

A spider may be flexible or rigid. The shape and mechanical properties of the spiders in the anode structure may be the same as or different from the shape and mechanical properties of the spiders in the cathode structure. In a preferred embodiment the legs of the current carriers associated with the anode structure may be shorter than the legs of the current carriers associated with the cathode structure, such as 5-50% shorter, preferably 10-30% shorter. For example, relatively non-springy spiders with short legs are often preferred in the anode structure and relatively springy spiders with long legs are preferred in the cathode structure.

The use of spring-loaded spiders, at least at the cathode plate, enables the electrode structures to be spring-loaded to achieve zero gap operation with optimum pressure to minimise risk of separator/electrode damage. By "zero gap", we mean that there is substantially no gap between the electroconductive plate of the each electrode structure and the adjacent separator, i.e. so that adjacent electroconductive plates are in use only separated by the thickness of the separator.

The use of such a configuration with posts and current carriers is also advantageous in allowing the electrode to be disconnected and replaced.

The anode current carrier may be fabricated from a valve metal or an alloy thereof. "Valve metals" metals which grow a passivating oxide layer when exposed to air. The commonly understood valve metals, and those defined by the use of the term herein, are Ti, Zr, Hf, Nb, Ta, W, Al and Bi. The anode current carrier is preferably fabricated from titanium or an alloy thereof.

The cathode current carrier may be may be fabricated from materials such as stainless steel, nickel or copper, especially nickel or an alloy thereof.

Each current carrier is preferably made from the same metal as the electrically conductive plate with which it is in electrical contact and more preferably each post with which it is in contact is also made of the same metal.

The post in an anode structure ("anode-post") may also be made of a valve metal therefore, and is preferably made of titanium or an alloy thereof whilst the post in a cathode structure ("cathode-post") may be made of stainless steel, nickel or copper, especially nickel or an alloy thereof. In such a scenario the length of the electrically conductive pathway through the cathode-post is preferably greater than the length of the electrically conductive pathway through the anode post. Preferably the ratio of the length of the electrically conductive pathway through the cathode post to the length of the electrically conductive pathway through the anode post is at least 2:1, preferably at least 4:1 and more preferably at least 6:1. This is most readily achieved by the use of a cathode structure which comprises a dished recess provided with a plurality of outwardly projecting projections whilst the anode structure comprises a dished recess provided with a plurality of inwardly projecting projections.

The posts and the central portion of the current carriers may be load bearing, and where they are load bearing they are preferably are aligned with holes in the electrode. Electrically insulating, load-bearing pins may be provided, disposed at the ends of the posts/current carriers adjacent the electrode.

Corresponding posts and pins can be provided in an adjacent electrode structure such that, when connected with a separator in between, load is transmitted from a post/current carrier/pin combination on one side of the separator, via the separator, to a pin/carrier/post combination on the other side of the separator. The load helps to maintain a good electrical connection between the pan on one side of the separator and the pan in the adjacent electrode structure, whilst the insulating pins transfer the load through the separator without causing mechanical damage to it. Since electrolysis does not occur at these points, the separator does not suffer from any electrolysis damage.

The preferred configuration is shown in FIGS. 1-6 as discussed further below.

The insulating pins may be made from entirely from an insulating material or may be made from a conductive material tined with an insulating cap or cushion adjacent the membrane.

Such insulating cushions may be made from a non-conductive material which is resistant to the chemical environment within the cell, e.g. fluoropolymers such as PTFE, FEP, PFA, polypropylene, CPVC and fluoroelastomeric rubbers. The cushions may be provided on metal studs which are located with the cushion presented towards the separator.

In particular, in the cathode structure the load bearing insulating pins may be made from nickel fitted with insulating fluoropolymer caps and in the anode structure the load bearing insulating pins may be made from titanium fitted with insulating fluoropolymer caps.

The current carriers are preferably designed such that in an electrode module comprising an anode structure and a cathode structure assembled with sealing means and a separator, in the area between adjacent rows and columns of recesses the maximum distance of any point on the separator from the nearest foot of a current carrier attached to the anode or from the nearest foot of a current carrier attached to the cathode is 50 mm or less, such as 30 to 50 mm.

In a further preferred embodiment, the legs or feet of the current carriers in one of the anode structure and the cathode structure are resilient whilst the current carriers on the other of the anode structure and the cathode structure are rigid, such that when an anode structure and a cathode structure separated by a separator between the two structures, the resilient legs or feet apply pressure from the electrode of one structure via a separator to the electrode of the other. Preferably, the pressure applied by one electrode to the other (via the separator) is greater than 0 $g/cm^2$ and less than 400 $g/cm^2$, such as less than 100 $g/cm^2$, and more preferably greater than 10 $g/cm^2$ and/or less than 40 $g/cm^2$.

The ability to provide low levels of pressure using resilient legs/feet is advantageous because it enables pressure to be applied with minimum risk of damage to the separator.

In general, in a particular electrode structure the pan, the electrode, the inlet and outlets for fluids and the electrically conductive pathways are all made from the same material. In an anode structure this is preferably titanium. In a cathode structure this is preferably nickel.

Either or both electrode structures may be fitted with baffles, for example so as to partition the electrode structure into two communicating flow zones extending vertically up the electrolyser which facilitate increased rates of internal liquor circulation by employing hydrodynamic lift.

For example, one or more baffles are preferably provided in the anode and cathode structures to form a first channel between a first side of the baffle and the electrode plate and a second channel between the second side of the baffle and the recessed dish of the pan, the first and second channels being in communication with each other, preferably at least at or adjacent the top and bottom of the electrode structure. The first channel provides a riser for the gas-filled brine to ascend to the outlet header at the top of the electrode structure. The second channel provides a downcomer for the degassed brine to fall to the bottom of the electrode structure. The baffles are preferably disposed vertically. The baffles utilise the gas-lift effect of the generated gas to enhance liquor circulation and mixing which produces certain advantages.

Improved mixing in the anode and cathode structures minimises concentration and temperature gradients within the structures thus increasing anode coating and membrane lifetime. In particular, in the anode structure the improved mixing allows the use of highly acidic brine to obtain low levels of oxygen in chlorine without the risk of damage to the membrane via protonation. The improvement in mixing in the cathode structure allows direct addition of de-ionised water to keep the concentration of caustic level constant after concentrated caustic is removed.

The provision of an inclined baffle plate in the upper region of the electrode structure further increases gas/liquid separation by accelerating the upward flow of the gas/liquid mixture from the electrolysis area thus enhancing gas bubble coalescence.

The baffles are made of material which is resistant to the chemical environment in the cell. The baffles in the anode structure may be made of a fluoropolymer or a suitable metal, for example titanium or an alloy thereof. The baffles in the cathode structure may be made of a fluoropolymer or a suitable metal, for example nickel.

In a preferred embodiment, a shoulder can be provided on the conductive posts connected to the current carriers. This can facilitate installation of baffles in the electrode structure, which makes manufacturing easier.

The electrode assembly according to the present invention may be a "bipolar electrode unit" or an "electrode module" as defined above, depending on how the anode and cathode are connected.

The present invention is further illustrated by reference to, but is in no way limited by, the following drawings, in which.

Figure 1:
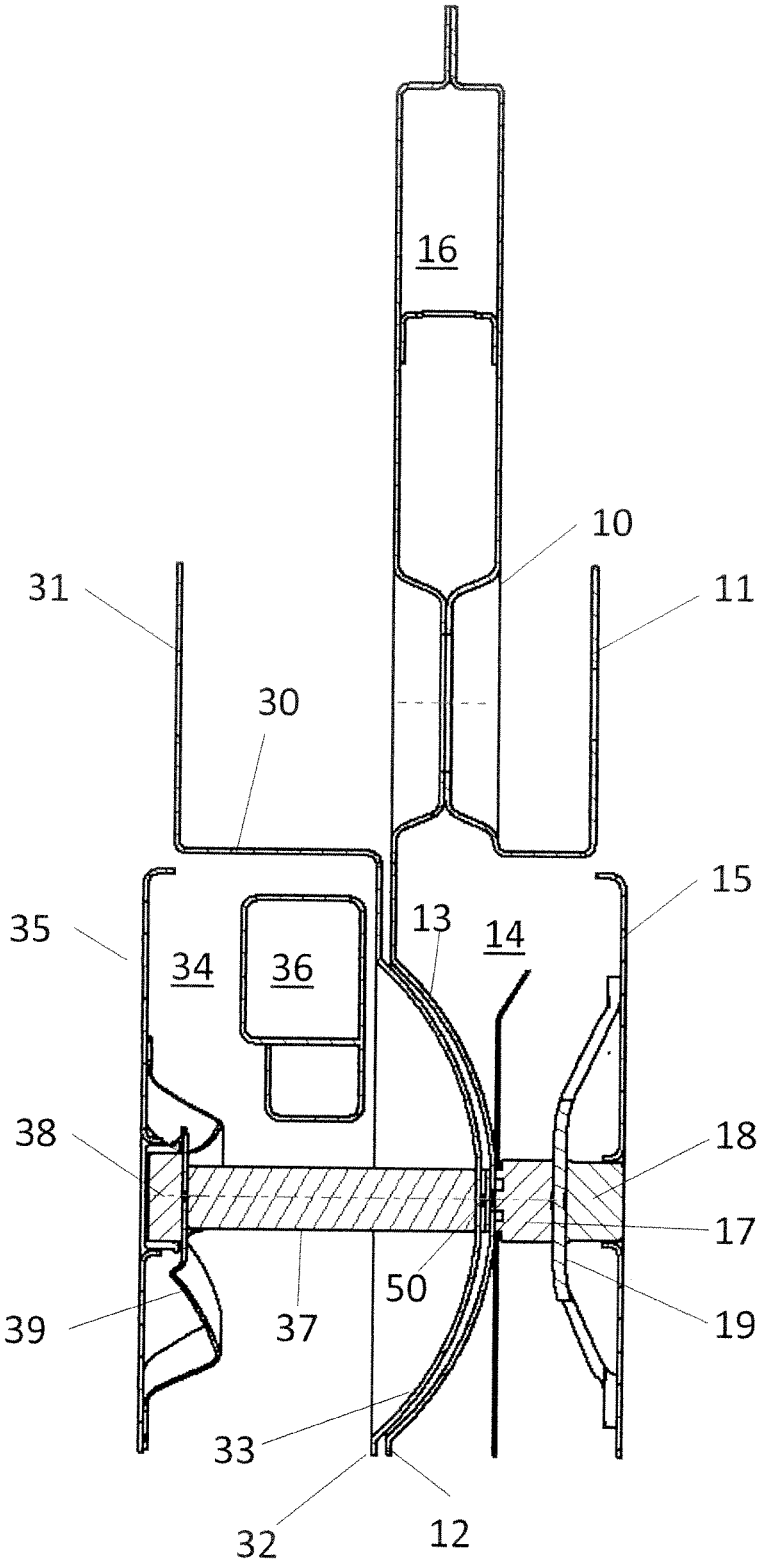
FIG. 1 is a cross-section of the top part of a preferred bipolar electrode unit showing an example with a combination of internal and external headers.

In FIG. 1 there is shown a bipolar electrode unit comprising an anode structure (10) and a cathode structure (30).

The anode structure (10) comprises a flange (11), and a dished recess (12) with an inwardly projecting projection (13), which forms an electrolysis compartment (14) containing an anode (15). The anode structure has an external outlet header (16). The anode (15) is typically in the form of a perforated plate.

The cathode structure (30) comprises a flange (31), and a dished recess (32) with an outwardly projecting projection (33), which forms an electrolysis compartment (34) containing a cathode (35). The cathode structure internal outlet header (36). The cathode (35) typically in the form or a perforated plate.

The anode structure (10) is electrically connected to the cathode structure (30) via a conductivity enhancing device (50) disposed between the inwardly projecting projection (13) on the anode structure (10) and the outwardly projecting projection (33) on the cathode structure (30).

In practise there are multiple inwardly outwardly projecting projections on each electrode structure, and multiple conductivity enhancing devices such that when the two electrode structures are urged together, the conductivity enhancing devices afford good electrical continuity between the peaks of the cathode structure projections (33) and the anode structure projections (13). The conductivity enhancing device may be in the form of an abrasion device (more preferably) a bimetallic disc. When the bipolar electrode unit is supplied pre-assembled for use in a filter press bipolar electrolyser, it is possible for the conductivity enhancing device (50) to be omitted completely and instead for the anode and cathode structure to be electrically and mechanically connected together by welding, explosion bonding or a screw connection.

The anode and cathode structures further comprise electrically conductive posts (17, 37), which connect to the respective projections (13, 33), electrically insulating cushions (18, 38) and current carriers which are each in a form having a central portion from which two or more legs radiate (hereinafter referred to as "spiders")(19, 39). The spiders (19, 39) are mounted between the respective posts (17, 37) and the respective electrodes (15, 35). At the location of the respective posts (17, 37), the electrodes (15, 35) are apertured and the cushions (18, 38) are received within the holes and rest on the central base of the spiders (19, 39).

Flow of liquor from the anode electrolysis compartment (14) to the external outlet header (16) takes place via a slot at the upper end of the anode structure (10), the slot being located immediately above the anode (15).

Flow of liquor from the cathode electrolysis compartment (34) to the internal outlet header (36) takes place via a slot in the internal outlet header in the upper region of the cathode structure (30).

Figure 2:
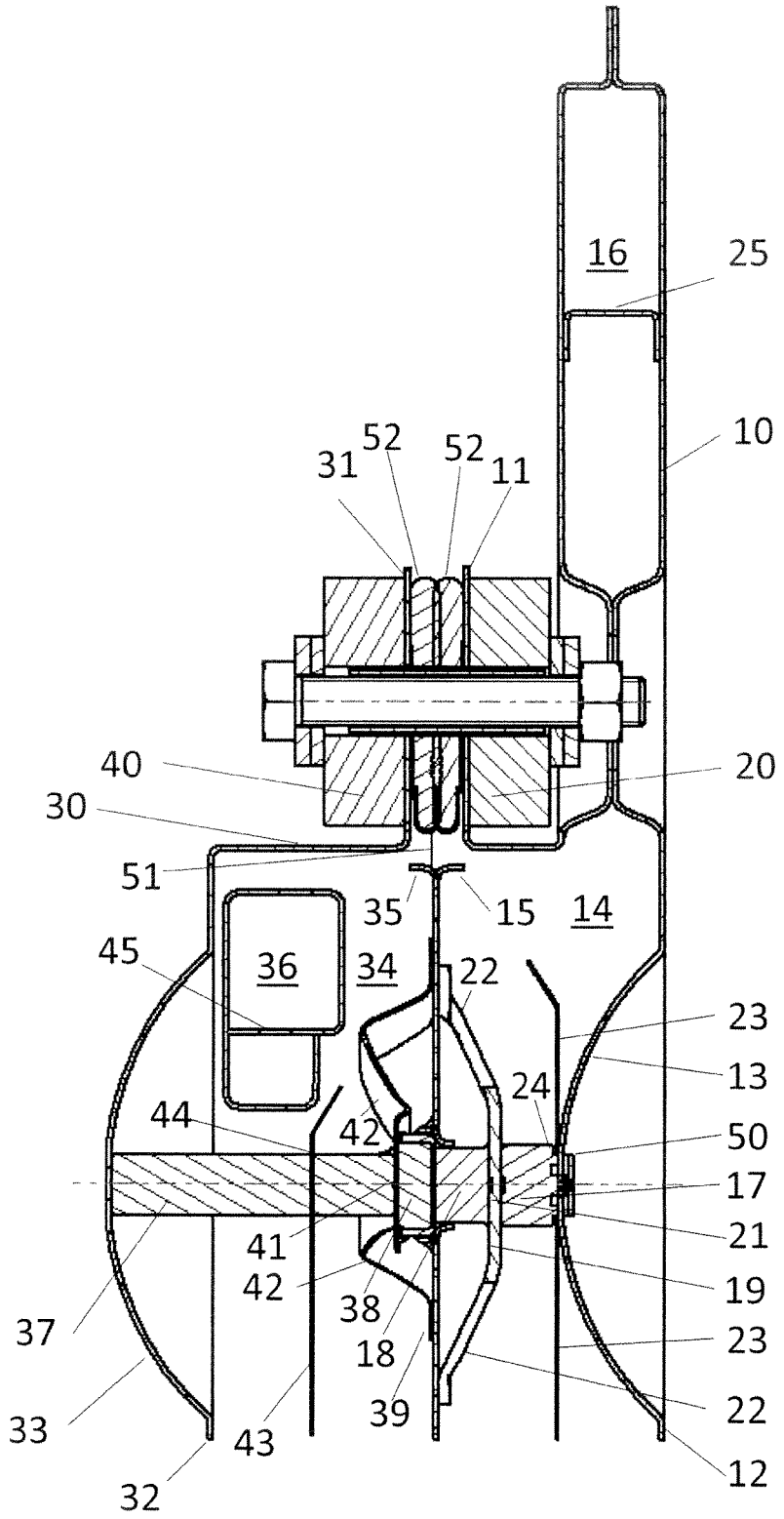
FIG. 2 is a cross-section of the top part of a preferred electrode module showing an example with a combination of internal and external headers.

In FIG. 2 there is shown an electrode module comprising an anode structure (10) and a cathode structure (30). The anode and cathode structures are broadly as defined for FIG. 1 and the same numbering is used as for the corresponding features already described for FIG. 1. However, the respective electrode structures are in this Figure joined with the anode (15) and cathode (35) facing each other with a membrane (51) in between. In particular, the flanges (11, 31) are provided with backing flanges (20, 40) with holes to accept bolts (not shown) for bolting be anode structure (10) and the cathode structure (30) with two gaskets (52) and the membrane (51) to form a module. The membrane (51) passes down through the electrode module between the anode (15) and cathode (35), providing fluid separation between the respective electrolysis compartments (14, 34) of said anode and cathode structures (10, 30).

The spider (19) in the anode electrolysis compartment (14) comprises a disc-shaped central section (21) which can be connected to the end of the post (17), e.g. by welding, screw-fixing or push-fit connectors, and a number of legs (22) which radiate from the central section (21) and are connected at their free ends, e.g. by welding, to the anode (15). Usually the legs (22) are arranged so that the current supply via the post (17) is distributed to a number of equispaced points surrounding the post (17).

The spider (39) in the cathode electrolysis compartment (34) comprises a disc-shaped central section (41) which can be connected to the end of the post (37), e.g. by welding, screw-fixing or push-fit connectors, and a number of legs (42) which radiate from the central section (41) and are connected at their free ends, e.g. by welding, to the cathode (35). Usually the legs (42) are arranged so that the current supply via the post (37) is distributed to a number of equispaced points surrounding the post (37).

In practice, during the production of the electrode structures (10, 30), the spiders (19, 39) may be welded or otherwise connected to the electrodes (15, 35) and the spiders may then be subsequently welded or otherwise secured to the posts (17, 37). This arrangement facilitates replacement or repair of the anode/cathode plates or renewal/replacement of any electrocatalytically-active coating thereon.

Also shown in FIG. 2 are baffles (23, 43) which may serve to partition, respectively, each anode compartment and each cathode compartment into two communicating zones to provide liquor recirculation as discussed further below. The provision of baffles in either compartment is optional, but it is particularly preferred that baffles are provided in the anode compartment. Without wishing to be bound by theory it is believed that recirculation in the anode compartment is useful in providing increased rates of electrolysis, for example by facilitating operation at higher current density.

The baffles (23, 43) may be mounted on the electrically conductive posts (17, 37). Each of the posts may be provided with a shoulder (24, 44) to facilitate installation and accurate location of the baffles.

Also shown in FIG. 2 are a cross-member (25) in the external outlet header (16) of the anode and a cross-member (45) in the internal outlet header (36) of the cathode.

Figure 3A:
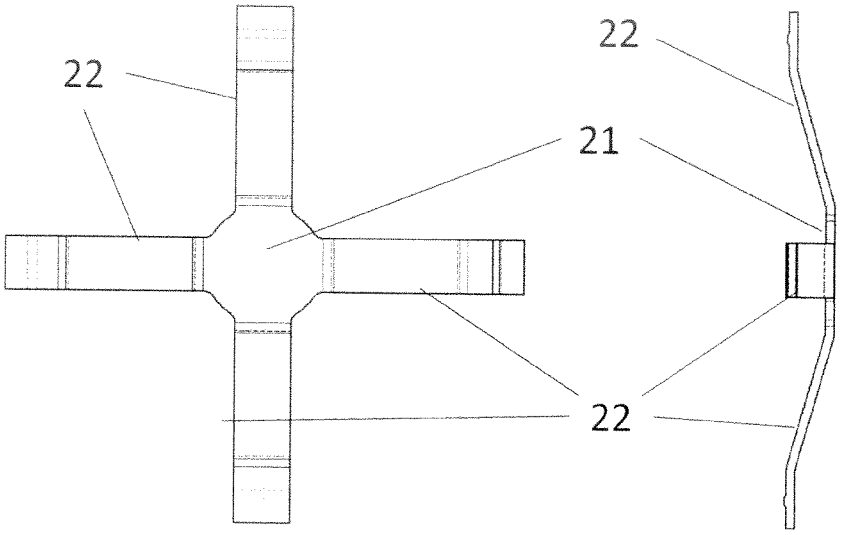
FIGS. 3A and 3B show, respectively, examples of "spiders" suitable for use in the anode and cathode structures.
Figure 3B:
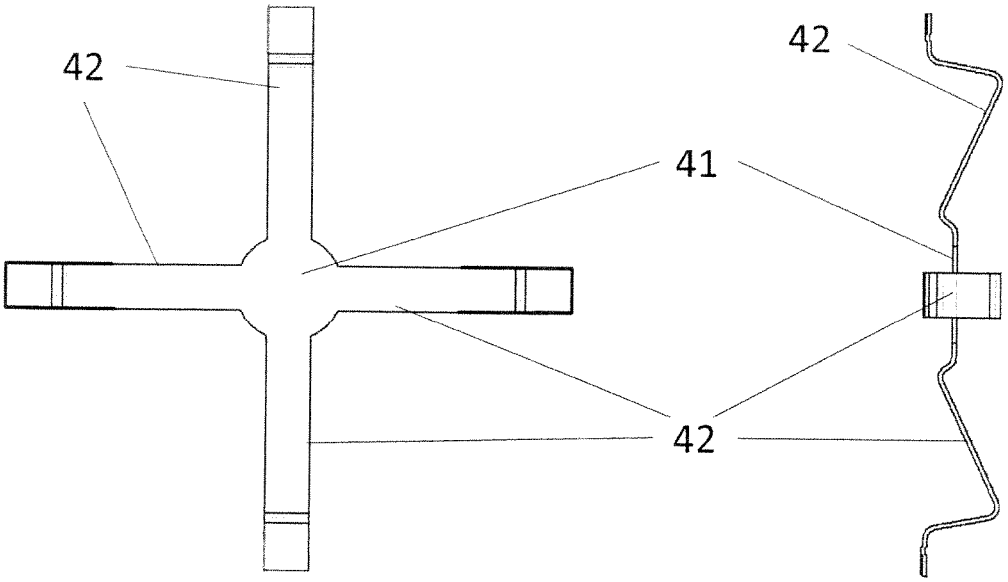

FIGS. 3A and 3B show, respectively, examples of suitable "spiders" for use in the anode and cathode structures.

With respect to FIG. 3A the spider comprises a disc-shaped central section (21) and 4 legs (22) which radiate from the central section (21). The legs (22) radiate symmetrically so that in use the current supply is distributed to a number of equispaced points.

Especially when intended for use in the electrolysis of alkali metal halides, the anode spiders are fabricated from a valve metal or alloy thereof.

With respect to FIG. 3B the spider comprises a disc-shaped central section (41) and 4 legs (42) which radiate from the central section (41). The legs (42) radiate symmetrically so that in use the current supply is distributed to a number of equispaced points.

Especially when intended for use in the electrolysis of alkali metal halides, the cathode spiders may be may be fabricated from materials such as stainless steel, nickel or copper.

As shown, the legs (42) of the cathode spider are longer and configured to be relatively springy, whilst the legs (22) of the anode spider are shorter and more rigid.

Figure 4A:
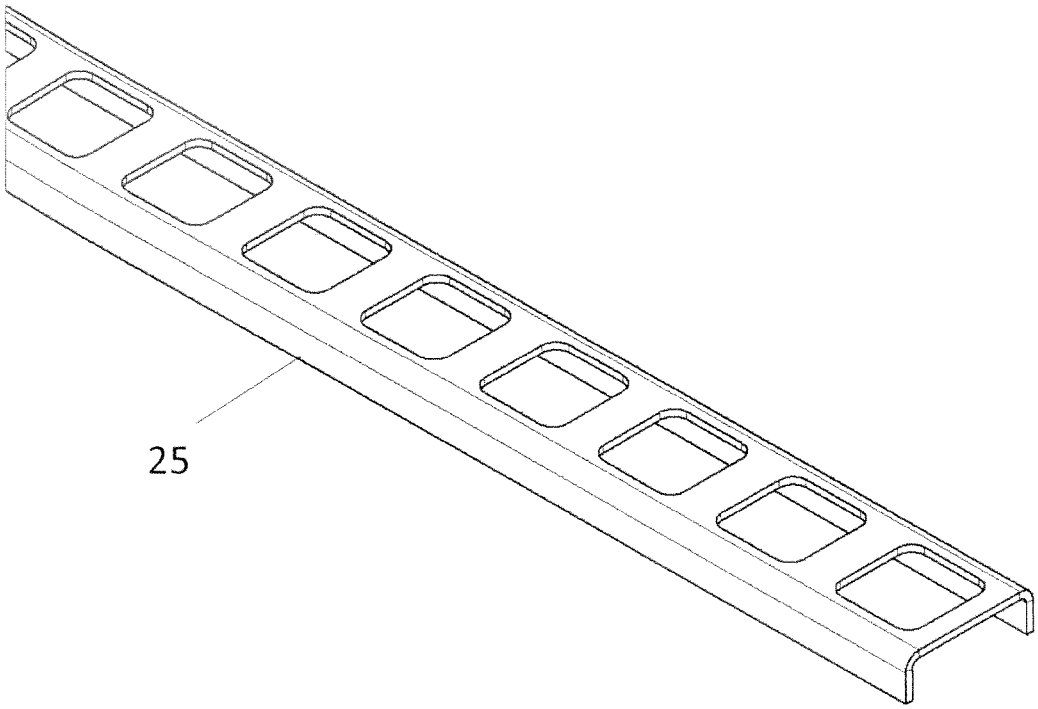
FIGS. 4A and 4B show close-ups of examples of preferred structures of cross-members in external and internal outlet headers.
Figure 4B:
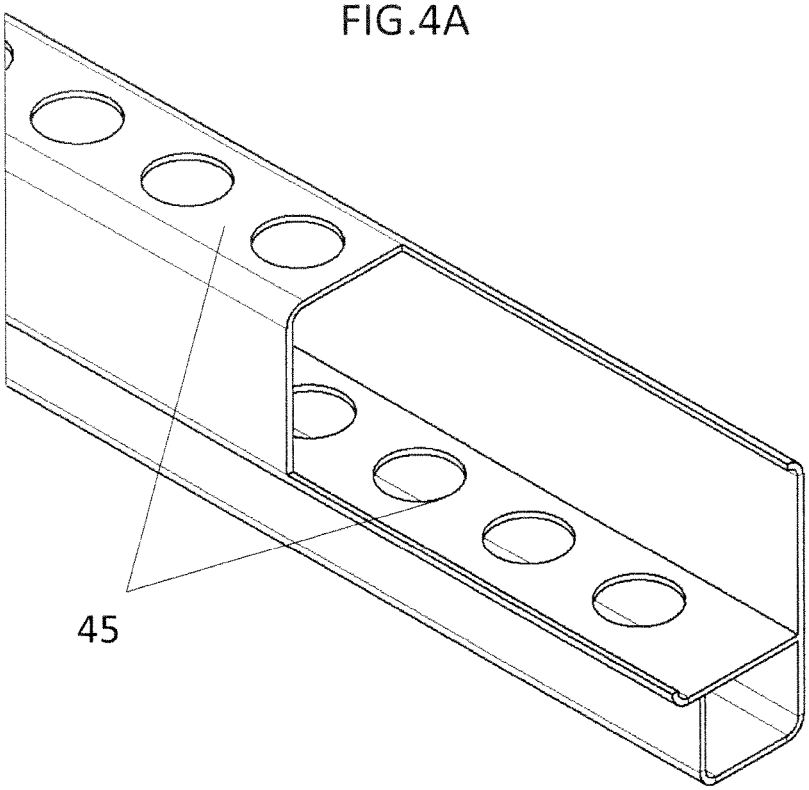

FIGS. 4A and 4B show respectively close-ups of the preferred structures of the cross-members (25) and (45). The preferred structure of the cross-member (25) in the external outlet header (16) is in the form of a "ladder" type arrangement, whilst the preferred structure of the cross-members (45) in the internal outlet header (36) is in the form of plates with round holes. As shown in FIG. 4B, there may be more than one cross-member (45) in the outlet header (36). Although only a single cross-member (25) is shown in FIGS. 1 and 2 there may also be more than one cross-member in the outlet header (16)

Figure 5:
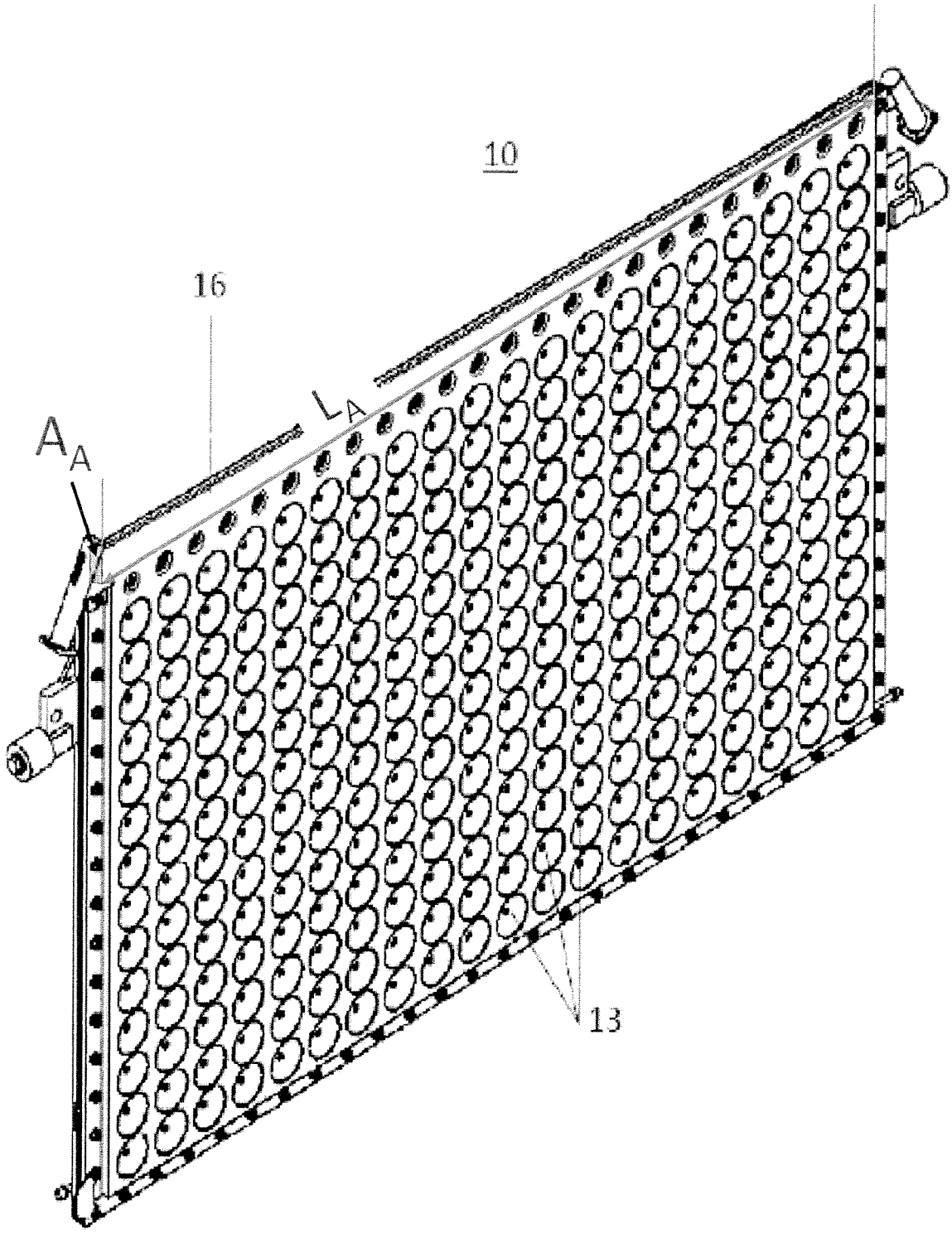
FIG. 5 is an isometric view looking at an anode structure showing an example of a preferred external header design according to the present invention.

FIG. 5 shows an anode structure (10) more detail, showing inwardly projecting frusto-spherical projections (13) and a tapered external outlet header (16). FIG. 5 also exemplifies the locations for the measurements of the $A_A$ and $L_A$.

Figure 6:
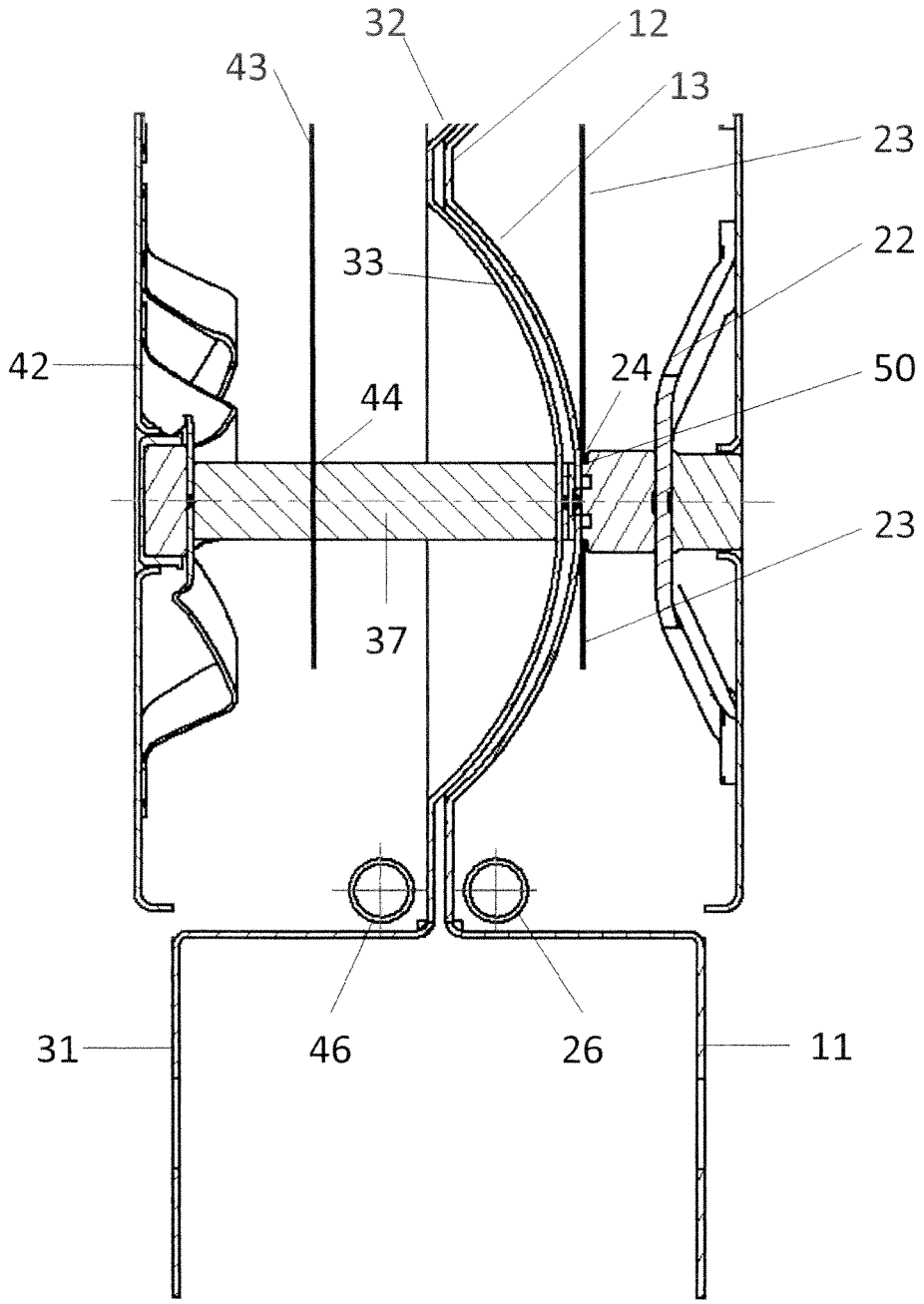
FIG. 6 is a cross-section of the bottom part of a bipolar electrode unit.

FIG. 6 shows a cross-section of the bottom part of a bipolar electrode unit. As with the Figures above the same numbering is used as for the corresponding features already described. In this Figure the anode structure is provided with an anode inlet tube (26) whilst the cathode structure is provided with a cathode inlet tube (46). Ports (not shown) are provided in the respective inlet tubes for discharge of liquor into the respective electrolysis compartments, and are preferably formed such that liquor discharged therefrom is directed towards the back of the pans behind the baffles (23, 43) to aid mixing. The baffles (23, 43) extend vertically within the respective anode and cathode compartments from the lower end of the electrode structure to the upper ends thereof and form two channels within each electrode structure which communicate at least adjacent the top and bottom of the structure.

In a third aspect the present invention provides a modular or filter press electrolyser comprising a plurality of electrode assemblies according to the first and/or second aspects.

For example, the third aspect of the present invention may provide a filter press electrolyser comprising a plurality of connected bipolar electrode units, adjacent bipolar electrode units being connected via a separator and sealing means between flanges on the adjacent units. The separator and sealing means are preferably as described between electrode structures when configured as an electrode module in the first aspect.

A bipolar electrode unit comprises an anode structure and a cathode structure which are electrically connected to each other. Preferably, in particular using the preferred electrode structures comprising a pan with a dished recess, the recessed dish of the anode pan and the recessed dish of the cathode pan are electrically joined, preferably at the apices of the projections.

Electrical conductivity may be achieved by the use of interconnectors or by close contact between the electrode structures. Electrical conductivity may be enhanced by the provision of conductivity-enhancing materials or conductivity-enhancing devices on the outer surface of the pans. As examples of conductivity-enhancing materials may be mentioned inter alia conductive carbon foams, conductive greases and coatings of a high-conductivity metal, e.g. silver or gold.

Preferably the anode structure and cathode structure in a bipolar electrode unit are electrically connected via welding, explosion bonding or a screw connection.

Alternatively, the third aspect of the present invention may provide a modular electrolyser. A modular electrolyser comprises a plurality of connected electrode modules. In this case the electrode modules may be connected to each other by providing suitable electrical connections between adjacent modules.

For example, the recessed dish of the anode pan and the recessed dish of the cathode pan in adjacent modules are electrically joined, preferably at the apices of the projections.

Electrical conductivity may be achieved by the use of interconnectors or by close contact between the electrode structures. Electrical conductivity may be enhanced by the provision of conductivity-enhancing materials or conductivity-enhancing devices on the outer surface of the pans. As examples of conductivity-enhancing materials may be mentioned inter alia conductive carbon foams, conductive greases and coatings of a high-conductivity metal. e.g. silver or gold.

When connecting adjacent electrode modules together connections via welding, explosion bonding or a screw connection are not preferred. Instead connections are preferred which are formed by close physical contact between the adjacent electrode structures.

Electroconductivity-enhancing devices which can enhance the contact include electroconductive bimetallic contact strips, discs or plates, electroconductive metal devices, such as washers, or electroconductive metal devices adapted to (a) abrade or pierce the surface of the pans by cutting or biting through any electrically-insulating coating thereon. e.g. an oxide layer, and (b) at least inhibit formation of an insulating layer between the device and the surface of the pan (which may be referred to as an "abrasion device").

Such devices are described further in U.S. Pat. No. 6,761,808.

The number of anodes and cathodes (or modules or bipolar units) may be chosen by the skilled man in the light of inter alia the required total production, available power and voltage and certain constraints known to the skilled man. Typically, however, a modular or filter press electrolyser according to the third aspect of the present invention comprises 5-300 assemblies i.e. 5 to 300 anode electrode structures and the same number of cathode electrode structures.

In a fourth aspect there is provided a process for the electrolysis of an alkali metal halide which comprises subjecting an alkali metal halide to electrolysis in a modular or filter press electrolyser according to the third aspect.

The modular or filter press electrolyser according to the fourth aspect of the present invention may generally be operated according to known methods. For example, it is typically operated at pressures between 50 and 600 kPa (0.5 and 6 bar) absolute pressure, preferably between 50 and 180 kPa (500 and 1800 mbar).

Liquid to be electrolysed is fed to the inlet-tubes in each electrode structure. For example, the inlet-tubes allow caustic to be charged to the cathode structure and brine to be charged to the anode structure. Products, namely chlorine and depleted brine solution from the anode structure and hydrogen and caustic from the cathode structure, are recovered from the respective headers.

The electrolysis may be operated at high current density, i.e. >6 kA/m$^2$.

The preferred features of the electrode assemblies/electrolyser used for the fourth aspect are generally as described above.

A particular advantage of an electrode assembly where the outlet header on the anode structure has a reduced volume, $V_C$, and/or a $V_A/(A_A \times L_A)$ of less than 1 is that higher chlorine production can be obtained per unit volume of outlet header on the anode structure in an electrolyser.

Thus, in a fifth aspect, the present invention provides a process for the electrolysis of an alkali metal halide which comprises subjecting an alkali metal halide to electrolysis in a modular or filter press electrolyser which electrolyser comprises i) a plurality of anode electrode structures having anode outlet headers, the anode outlet headers having an internal volume, $V_A$ cm$^3$, ii) a plurality of cathode electrode structures, having cathode outlet headers, the cathode outlet headers having an internal volume, $V_C$, cm$^3$, wherein the process is operated at an production rate per anode electrode assembly of $W_A$, kg $Cl_2$/hr, wherein $W_A/V_A$ is greater than 0.006 kg $Cl_2$/hr cm$^3$.

It is particularly preferred in this fifth aspect that i) the anode outlet headers have an internal volume, $V_A$ cm$^3$, an internal cross sectional area at the exit end of the header of $A_A$ cm$^2$ and an internal length $L_A$ cm, and ii) the cathode outlet headers have an internal volume. $V_C$ cm$^3$, an internal cross sectional area at the exit end of the header of $A_C$ cm$^2$ and an internal length $L_C$ cm.

and wherein one or both of the ratios $V_A/(A_A \times L_A)$ and $V_C/(A_C \times L_C)$ are less than 1, and most preferably that at least the anode outlet headers have ratios $V_A/(A_A \times L_A)$ less than 1.

In relation to the fifth aspect of the present invention it should be noted that all anode electrode structures in an electrolyser are usually identical and all cathode electrode structures in an electrolyser are usually identical.

In such a scenario $V_A$, $A_A$ and $L_A$ are the same for all anode electrode structures and $V_C$.

$A_C$ and $L_C$ are the same for all cathode electrode structures. The requirement for $W_A/V_A$ and $V_A/(A_A \times L_A)$ should be met by all anodes and/or the requirement for $V_C/(A_C \times L_C)$ should be met by all cathodes.

However, if it were the case that one or more anode electrode structures are provided which have different outlet header dimensions than others present then $V_A$, $L_A$, $A_A$ and $W_A$ should be taken for the anode outlet headers with the lowest volume among those present, and $W_A/V_A$ greater than 0.006 kg $Cl_2$/hr $cm^3$ and $V_A//(A_A \times L_A)$ less than 1 need be met by these anodes only.

Preferably at least 80% by number of the anode electrode structures have the same $V_A$, $L_A$, $A_A$, and most preferably all anode outlet headers have the same $V_A$, $L_A$, $A_A$.

Similarly, if it were the case that one or more cathode electrode structures are provided which have different outlet header dimensions than others present then $V_C$, $L_C$ and $A_C$ should be taken as required for the cathode outlet headers with the lowest volume among those present.

In those cases where the electrolyser contains cathodes with $V_C/(A_C \times L_C)$ less than 1, preferably at least 80% by number of the cathode electrode structures have the same $V_C$, $L_C$ and $A_C$, and $V_C/(A_C \times L_C)$ less than 1 need be met by these cathodes only. Most preferably all anode outlet headers have the same $V_C$, $L_C$ and $A_C$.

In this fifth aspect preferably $W_A/V_A$ at least 0.008 kg $Cl_2$/hr $cm^3$, such as at least 0.010 kg $Cl_2$/hr $cm^3$. There is no specific upper limit but $W_A/V_A$ may be generally up to 0.020 kg $Cl_2$/hr $cm^3$, such as up to 0.015 kg $Cl_2$/hr $cm^3$.

It should be noted that, once an electrolyser is built, the value of $V_A$ is fixed. However, electrolysers can be operated at varying production rates, and hence $W_A/V_A$ can vary during operation depending on the total production rate.

Typically production rate increases with increased current density. However, electrolysers and their membrane separators are designed to operate at a particular maximum current density and significantly increasing production rate by increasing current density is not possible above a certain limit. Thus, the values of $W_A/V_A$ provided by the present invention are considered to be higher than those obtainable whilst operating stably in current commercial electrolysers.

The typical current density at which modern electrolysers are routinely operated is 4 to 7 kA/$m^2$.

The current density when operating the process according to the present invention is typically similar to this range, and hence is preferably at least 4 kA/$m^2$, especially at least 6 kA/$m^2$, The current density is preferably less than 7 kA/$m^2$.

$W_A$ in the fifth aspect of the present invention is the production rate from the individual anode under consideration. $W_A$ is typically 4 to 40 kg $Cl_2$/hr, and preferably 20 to 40 kg $Cl_2$/hr. Alternatively, or additionally, $W_A$ is above 12 kg $Cl_2$/hr at a current density of 4 KA/$m^2$ and above 21 kg $Cl_2$/hr at a current density of 7 KA/$m^2$. $W_A$ may be determined by methods known to those skilled in the art, for example by measuring the current flow through the electrolyser over a given time period and the current efficiency of the electrolyser over the same period, for example using the 'sulphate key' technique, using these numbers to calculate the mass of chlorine in kg produced in the entire electrolyser over that time period, dividing the number obtained by the number of electrode assemblies in the electrolyser and then dividing by the length of the measurement period in hours to produce the measured chlorine production per electrode assembly in kg $Cl_2$/hr.

In one embodiment the electrolyser of the third to fifth aspects of the present invention may also be characterised that it has $W_A/V_A$ of at least 0.006, preferably of at least 0.010, when operated at a current density of 7 kA/$m^2$ and $W_A/V_A$ of at least 0.003, preferably of at least 0.005, when operated at a current density of 4 kA/$m^2$. For avoidance of doubt, this does not mean that the electrolyser must be operated at all times at one of these current densities, but simply that such minimum values of $W_A/V_A$ are obtained if it is operated at these current densities.

The combination of high current density and high anode production rate per unit volume of outlet header on the anode structure is typically achieved by reducing the total volume, $V_A$, of the outlet header compared to current commercial electrolysers.

In a preferred embodiment of the third to fifth aspects of the present invention the modular or filter press electrolyser comprises a plurality of anode electrode structures having external anode outlet headers, and a plurality of cathode electrode structures, having internal cathode outlet headers or vice versa.

Particularly preferred however, is a modular or filter press electrolyser which electrolyser comprises a plurality of anode electrode structures having external anode outlet headers, and a plurality of cathode electrode structures having internal cathode outlet headers.

In a yet further aspect the present invention provides an electrode structure comprising:

i) a pan with a dished recess and a flange which can interact with a flange on a second electrode structure to hold a separator in between the two and the dished recess further having a plurality of inwardly or outwardly projecting projections which can mate with corresponding projections on a third electrode structure in an electrode unit or in a modular electrolyser, ii) an inlet for liquid to be electrolysed and iii) an outlet header for evolved gas and spent liquid, wherein the outlet header is an external outlet header in which $V_E/(A_E \times L_E)$ is less than 1, where $V_E$ is the internal volume of the external outlet header in $cm^3$, $A_E$ is the internal cross sectional area at the exit end of the header $L_E$ is the internal length, and preferably wherein the outlet header is a tapered external outlet header which increases in cross-section area in the direction of gas/liquid flow towards the exit ports.

The features of the electrode structure in this aspect may be generally as described for the corresponding individual electrode structure with external header in the first aspect.

For example, the preferred electrode structure comprises a dished recess which is provided with a plurality of inwardly projecting projections.

Similarly, the external outlet header in this aspect preferably comprises one or more internal cross members located along part of or all of the horizontal length of and attached internally to the sides of the header.

As a further example, the depth of the external outlet header may exceed the depth of the claimed electrode structure. In particular, when connected to said second and/or third electrode structure in an electrode module, electrode unit or modular electrolyser, the external outlet header of the claimed electrode structure can occupy space which is vertically above the second and/or third electrode structures.

In a most preferred embodiment of this aspect the flange is around the periphery of the dished recess and being for supporting a gasket capable of sealing the separator between the electrode surface of the claimed electrode structure and the electrode surface of the second electrode structure such that the electrode surfaces are substantially parallel to and face each other, but are spaced apart from each other by the separator and are hermetically sealed to the separator. Further, the electrode structure comprises an electrode spaced from the pan hut connected to the pan by electrically conductive pathways between the pan and the electrode with the proviso that where the claimed electrode structure is provided with a plurality of inwardly projecting projections the electrode may be directly electrically connected to the pan.

The electrode structure in this aspect is preferably an anode structure. In particular, as already described the separator is most prone to damage caused by the formation of a gas space adjacent the separator on the anode side in the upper region of an electrolysis compartment, and also because the separation of formed chlorine from spent brine is the most problematic. The external outlet header located above the electrolysis compartment allows to minimise these problems because its location moves the gas disengagement area away from the separator and also provides increased flexibility to design its shape and size to improve the separation.

EXAMPLE 1

A bipolar electrolyser was formed of 5 modules of the general structure shown in FIG. 2, with an external anode outlet header and an internal cathode outlet header. The anode structures were themselves as shown in FIG. 5 with a tapered external outlet header. The anode outlet header extends across the full width of the anode to have a length, $L_A$ of 244 cm, and depth of 1.9 cm, but with an increasing height, thereby leading to an increased cross-sectional area, $A_A$, at the end of 18.8 $cm^2$. The anode outlet header had a volume, $V_A$, of 2294 $cm^3$.

The cathode structure has an internal outlet header which also extends across the full width of the cathode to have a length ($L_C$ of 244 cm), but has a constant rectangular cross-sectional area $A_C$ of 11.6 $cm^2$ and a volume, $V_C$ of 2030 $cm^3$. The ratio $V_A/(A_A \times L_A)$ in this electrolyser was 0.5 and $V_A$ was 264 $cm^3$ lower than $V_C$ Electrolysis was performed over an operating life of 4 years using Nafion 2030 membrane from The Chemours Company LLC (a subsidiary of E. I. DuPont de Nemours & Company) at an inlet sodium hydroxide concentration of 30%, and exit sodium hydroxide concentration of 32%, an inlet brine concentration of 300 g NaCl/litre and an exit brine concentration of 220 g/NaCl/litre, an average sodium hydroxide exit temperature of 87° C. and an operating pressure of 250 mbarg hydrogen and 235 mbarg chlorine. Current efficiency over the 4 year period ranged from 97% at first start-up to 95.5% after 4 years with an average of 96.5%. The average operating current density over the 4 year period was approximately 5 $kA/m^2$ with the maximum 6 $kA/m^2$. The average rate of evolution of chlorine gas from each anode over the entire 4 year period of operation was 18.4 kg/hr with the maximum rate being 22.3 kg/hr.

Operation was performed without any problems of separation in either the anode or cathode outlet headers as indicated by the stability of the operating voltage and current efficiency of the electrolyser, which was identical to a comparison electrolyser with external, non tapered, anode and cathode headers (see below). Electrodes and membranes were removed from the test electrolyser for examination after 4 years on load and showed no signs membrane blistering or electrode coating damage which might have otherwise been indicative of inadequate internal circulation caused by poor gas separation in the headers.

COMPARATIVE EXAMPLE

An electrolyser was formed of 138 modules of the general structure shown in U.S. Pat. No. 6,761,808, having both an external anode outlet header and an external cathode outlet header, and in which neither was tapered.

The cathode structure had an external outlet header which also extended across the full width of the cathode ($L_C$=244 cm), but had a constant rectangular cross-sectional area, $A_C$ of 18.8 $cm^2$ and a volume, $V_C$ of 4587 $cm^3$.

The anode structure also had an external outlet header which also extended across the full width of the anode ($L_A$=244 cm) and had a constant rectangular cross-sectional area, $A_A$ of 18.8 $cm^2$ and a volume, $V_A$ of 4587 $cm^3$, the ratio $V_A/(A_A \times L_A)$ in this electrolyser was 1.0 and $V_A$ was identical to $V_C$.

Electrolysis was performed over an operating life of 4 years using Nation 2030 membrane from The Chemours Company LLC (a subsidiary of E. I. DuPont de Nemours & Company) at an inlet sodium hydroxide concentration of 30%, and exit sodium hydroxide concentration of 32%, an inlet brine concentration of 300 g NaCl/litre and an exit brine concentration of 220 g/NaCl/litre, an average sodium hydroxide exit temperature of 87° C. and an operating pressure of 250 mbarg hydrogen and 235 mbarg chlorine. Current efficiency over the 4 year period ranged from 97% at first start-up to 95.5% after 4 years with an average of 96.5%. The average operating current density over the 4 year period was approximately 5 $kA/m^2$ with the maximum 6 $kA/m^2$. The average rate of evolution of chlorine gas from each anode over the entire 4 year period of operation was 18.4 kg/hr with the maximum rate being 22.3 kg/hr.

Operation was performed without any problems of separation in either the anode or cathode outlet headers. As indicated by the stability of the operating voltage and current efficiency of the electrolyser. The values for the operating voltage and current efficiency of the electrolyser measured over time over me were virtually identical to those measured in example 1 above. Electrodes and membranes were removed from the test electrolyser for examination after 4 years on load and showed no signs of membrane blistering or electrode coating damage which might have otherwise been indicative of inadequate internal circulation caused by poor gas separation in the headers.

What is claimed is:

1. An electrode assembly comprising an anode structure and a cathode structure, each of said anode structure and cathode structure comprising an outlet header for evolved gas and spent liquid, wherein i) the outlet header on the anode structure has an internal volume, $V_A$ $cm^3$, an internal cross sectional area at the exit end of the header of $A_A$ $cm^2$ and an internal length $L_A$ cm, and ii) the outlet header on the cathode structure has an internal volume, $V_C$ $cm^3$, an internal cross sectional area at the exit end of the header of $A_C$ $cm^2$ and an internal length $L_C$ cm, And wherein one or both of the following apply:

a) the outlet header on the anode structure is an external header and the ratio $V_A/(A_A \times L_A)$ is less than 1, and b) the outlet header on the cathode structure is an external header and the ratio $V_C/(A_C \times L_C)$ is less than 1.

2. An electrode assembly comprising an anode structure and a cathode structure, each of said anode structure and cathode structure comprising an outlet header for evolved gas and spent liquid, wherein the outlet header on the anode structure has a total internal volume of $V_A$ $cm^3$ and the outlet header on the cathode structure has a total volume of $V_C$ $cm^3$ wherein $V_A$ is less than $V_C$.

3. An electrode assembly according to claim 2 wherein i) the outlet header on the anode structure has an internal cross sectional area at the exit end of the header of $A_A$ $cm^2$ and an internal length $L_A$ cm, and ii) the outlet header on the cathode structure has an internal cross sectional area at the exit end of the header of $A_C$ $cm^2$ and an internal length $L_C$ cm, and wherein one or both of the following apply:

a) the outlet header on the anode structure is an external header and the ratio $V_A/(A_A \times L_A)$, and b) the outlet header on the cathode structure is an external header and the ratio $V_C/(A_C \times L_C)$ is less than 1.

4. An electrode assembly according to claim 1 wherein the outlet header on the anode structure is an external header and has $V_A/(A_A \times L_A)$ of less than 1, more preferably less than 0.95, such as less than 0.7, and preferably wherein the outlet header on the anode structure is tapered such that its cross-sectional area increases along its length.

5. An electrode assembly according to claim 1 wherein $A_A$ is at least 7 $cm^2$ and preferably at least 15 $cm^2$.

6. An electrode assembly according to claim 1 wherein $A_C$ is less than $A_A$, and preferably at least 5 $cm^2$ less than $A_A$.

7. An electrode assembly according to claim 1 wherein $V_A$ is less than 3100 $cm^3$ and/or wherein $V_A$ is 100 $cm^3$, more preferably 250 $cm^3$ less than $V_C$.

8. An electrode assembly according to claim 1 having an external anode outlet header and an internal cathode outlet header, or vice versa.

9. An electrode assembly as claimed in claim 8 wherein each outlet header is an outlet volume which is provided on the individual anode or cathode structure and by which evolved gas exits the anode or cathode structure to an electrolyser collection header, and preferably is an extended volume aligned parallel with the long horizontal axis of the electrode structure.

10. An electrode assembly according to claim 1 wherein the external outlet header or headers comprises one or more internal cross members located along part of or all of the horizontal length of and attached internally to the sides of the header.

11. An electrode structure comprising:

i) a pan with a dished recess and a flange which can interact with a flange on a second electrode structure to hold a separator in between the two and the dished recess further having a plurality of inwardly or outwardly projecting projections which can mate with corresponding projections on a third electrode structure in an electrode unit or in a modular electrolyser, ii) an inlet for liquid to be electrolysed and iii) an outlet header for evolved gas and spent liquid, wherein the outlet header is an external outlet header in which $V_E/(A_E \times L_E)$ is less than 1, where $V_E$ is the internal volume of the external outlet header in $cm^3$, $A_E$ is the internal cross sectional area at the exit end of the header $L_E$ is the internal length, and preferably is a tapered external outlet header which increases in cross-section area in the direction of gas/liquid flow towards the exit ports.

12. An electrode structure according to claim 11 wherein the external outlet header comprises one or more internal cross members located along part of or all of the horizontal length of and attached internally to the sides of the header.

13. An electrode structure according to claim 11 which is an anode structure.

14. A modular or filter press electrolyser comprising a plurality of electrode assemblies according to claim 1, and preferably which comprises 5-300 electrode assemblies.

15. A process for the electrolysis of an alkali metal halide which comprises subjecting an alkali metal halide to electrolysis in a modular or filter press electrolyser according to claim 14, and in particular wherein the process is operated at a production rate per anode electrode assembly of $W_A$, kg $Cl_2$/hr, wherein $W_A/V_A$ is greater than 0.006 kg $Cl_2$/hr $cm^3$.

16. A modular or filter press electrolyser comprising a plurality of electrode assemblies according to claim 2, and preferably which comprises 5-300 electrode assemblies.

17. A process for the electrolysis of an alkali metal halide which comprises subjecting an alkali metal halide to electrolysis in a modular or filter press electrolyser according to claim 16, and in particular wherein the process is operated at a production rate per anode electrode assembly of $W_A$, kg $Cl_2$/hr, wherein $W_A/V_A$ is greater than 0.006 kg $Cl_2$/hr $cm^3$.

* * * * *